United States Patent [19]

Michael

[11] Patent Number: 4,955,521

[45] Date of Patent: Sep. 11, 1990

[54] DOOR JAMB ASSEMBLY MACHINE WITH AUTOMATIC ALIGNMENT AND FEED

[75] Inventor: James V. Michael, Hayward, Calif.

[73] Assignee: Senco Products, Inc., Cincinnati, Ohio

[21] Appl. No.: 249,726

[22] Filed: Sep. 27, 1988

[51] Int. Cl.[5] ..... B25C 7/09

[52] U.S. Cl. ..... 227/3; 144/353; 227/4; 227/44; 227/50; 227/100; 227/150

[58] Field of Search ..... 144/353; 227/3, 4, 5, 227/39, 40, 44, 45, 48, 50, 99, 100, 150, 152

[56] References Cited

U.S. PATENT DOCUMENTS

| | | | |
|---|---|---|---|
| 3,263,723 | 8/1966 | Sheffield et al. | 144/3 R |
| 3,707,256 | 12/1972 | Lubin et al. | 227/7 |
| 4,254,895 | 3/1981 | Cheak | 227/50 |
| 4,463,887 | 8/1984 | Bloys | 227/45 X |

*Primary Examiner*—Paul A. Bell

*Attorney, Agent, or Firm*—Jerrold J. Litzinger

[57] ABSTRACT

A machine for assembling a jamb member, two sides members, and a stop member into a finished door jamb. The individual members are placed into the machine, which positions and aligns members and transports them in the proper relationship to a fastening station which automatically fastens the members into a door jamb assembly. The machine automatically spaces the fasteners along the length of the assembly.

17 Claims, 2 Drawing Sheets

DOOR JAMB ASSEMBLY MACHINE WITH AUTOMATIC ALIGNMENT AND FEED

FIELD OF THE INVENTION

The present invention relates to a door jamb assembly machine which automatically aligns and feeds the individual elongate members of the door jamb. The machine of the present invention aligns and registers the individual pieces of the door jamb as they are conveyed along a longitudinal path past at least one attaching position where the individual pieces of the door jamb are attached together, particularly with staples or nails at predetermined distances along the length of the door jamb. The present invention can also be adjusted to accept door jamb pieces of various sizes as these pieces generally vary in length, width and height. In a preferred embodiment, the driving motor of the conveyancing means is controlled by electronic feedback means which cause the conveyancing means to move in discrete, equidistant cycles along the longitudinal path of the device so that the machine can assemble a series of door jambs of equal length.

BACKGROUND OF THE INVENTION

The advantages of fabricating pre-hung doors have been known and utilized in the building industry and are exemplified by U.S. Pat. Nos. 3,263,723 and 4,100,611 which describe machines for preparing doors for hanging and for fabricating pre-hung doors.

Prefabrication has also been extended to the construction of certain parts of the frame which forms the door opening, such as the attachment of the individual pieces of the door jamb. In assembling the pieces of a door jamb, it is required that the stop, the sides, and the jamb be placed in the appropriate longitudinal, horizontal and vertical alignments prior to being attached. Prior devices related to door jamb assembly and the production of pre-hung doors include U.S. Pat. Nos. 3,707,256 and 4,254,895.

U.S. Pat. No. 3,707,256 relates to a machine for assembling and packaging a pre-hung interior door unit, complete with split latch and exterior trim. The machine uses an elongated horizontal bed provided with an endless chain for conveying the door and side jamb members past fixed stapling tools which staple the trim to their associated jamb members. A separate tool drives a temporary staple to hold the two sections of the jamb together. The jamb member of the pre-hung door unit is comprised of two pieces, male and female, with a tenon and mortise joint. The female halves of the hinge and latch jambs contain integral portions which extend inward toward the door opening along the length of the jamb and act as door stops. The header jamb is formed in the same fashion. These temporarily stapled door jamb assemblies are not finished but are packaged with a pre-hung door and must be separated along the tenon and mortise joint and installed in a door opening by bringing the two halves of the assembly together from either side of the door opening.

U.S. Pat. No. 4,254,895 relates to a machine for assembling a door jamb from standard mill wood pieces. The subject of the '895 patent is a machine which removes the door jamb pieces from hoppers provided for each piece type (i.e. door jamb, stop member, side member) and aligns and registers such pieces in close proximity to a fastening or stitching means (i.e. a series of nailing tools) each of which then permanently attaches the door jamb pieces by fastening the pieces at the particular location to which they are assigned. This type of machine does not easily accommodate door jamb pieces of various dimensions and cannot easily vary the number or location of the fasteners placed in the jamb.

The prior art discussed above has not facilitated the efficient, permanent assembly of finished door jambs which utilizes both a continuous longitudinal feed of the door jamb pieces, provides for the use of a minimum number of fastening stations, and allows for the convenient variation of the length of the door jamb and the number and position of attaching means (staples or nails) which are used to construct the door jamb. Also, the present invention allows for the construction of a finished door jamb from standard mill wood pieces and does not rely on jointed or otherwise pre-milled instruction.

It is therefore an object of the present invention to provide for a continuous feed machine for assembling finished door jambs.

It is also an object of the present invention to provide a door jamb machine which utilizes a minimum number of stapling stations. As opposed to that known in the prior art, the use of a minimum number of fastening stations in conjunction with a conveyancing means which passes the door jamb pieces thereby for attachment, as in the present invention, both reduces the cost and maintenance associated with a large number of fastening stations and allows for the number and position of attachment means (such as staples or nails) to be more easily varied.

Another object of the present invention is to provide for a door jamb machine which allows the length of the finished door jamb to be conveniently varied. This allows for the construction of door jambs for both the sides and the top of the door opening for door openings of any size, particularly those variations which are commonly encountered in building applications.

Still another object of the present invention is to provide a door jamb machine which can construct a finished door jamb from standard mill wood pieces. This significantly reduces the cost of raw materials. Furthermore, the present invention is distinguished over the prior art because it provides a machine capable of constructing a finished door jamb ready for installation without the necessity of the door jamb being halved and reconstructed from either side of the door opening.

These and other advantages will be apparent from the disclosure and drawings of the present invention contained herein.

SUMMARY OF THE INVENTION

Figure 1:
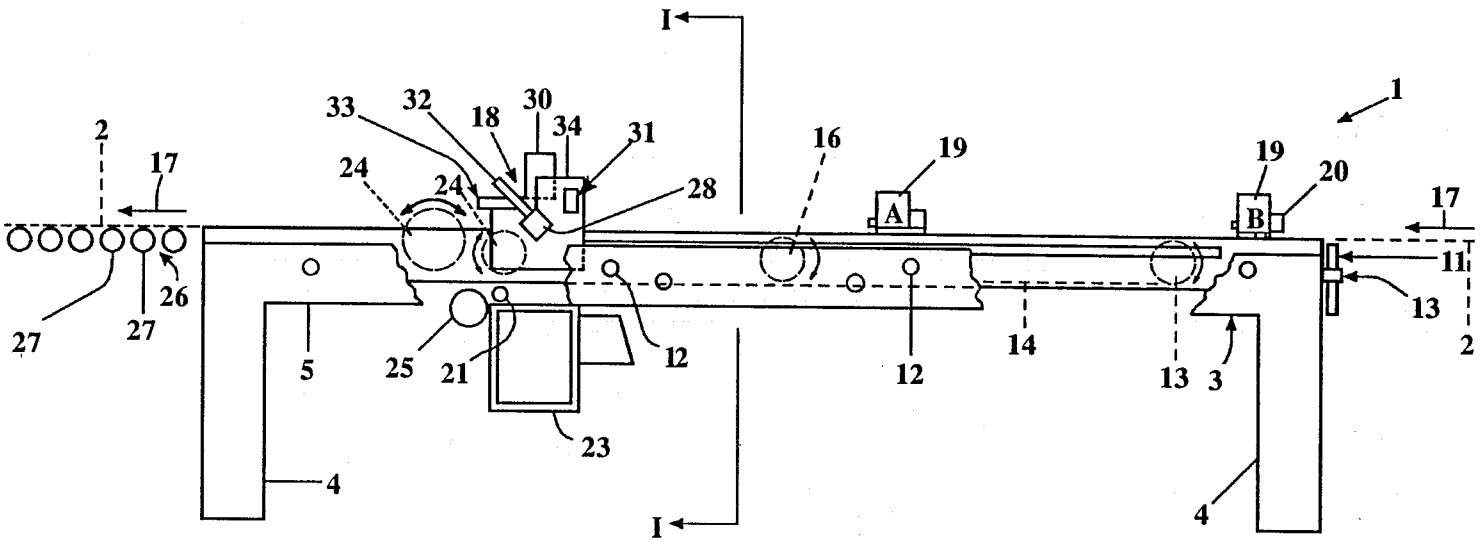
FIG. 1 is a side view of one embodiment of the present invention, having partial cut-away portions to better exhibit the conveyancing means and fastening station.

The above-described objects, and others, are accomplished by the present inventive door jamb machine which comprises means to support, align and register a jamb member, a stop member and at least one side member along a longitudinal path; conveyancing means to transport said members along the longitudinal path past at least one fastening station located along the longitudinal path; at least one fastening means located at each of said at least one fastening stations. The present invention may also be used to attach a side member on both lateral sides of the jamb member.

The means to support, align and register the parts of the door jamb may be adjustable so as to accommodate pieces of varying dimensions.

The support, alignment and registering means of the present invention may be any appropriate means apparent to one reasonably skilled in the art in light of the disclosure herein. Such means may, for example, comprise an elongated structural tube frame weldment which has legs to place the machine at a proper height with respect to the operator, such that the frame approximates the shape of a table. The "top" of this table supports the alignment and registering means for the door jamb members. An example of such an alignment system is to provide the top of the table fitted with upwardly-extending sides and, between these sides to have longitudinally extending plates which define spaces into which the side member(s) may be aligned and registered with the jamb member. The tops of the plates are also positioned so as to support and align the jamb member in relation to the side member(s). The stop member rides along the top of the jamb member and is stitched to the jamb member from above.

The support, alignment and registering means also serves to support the conveyancing means which may be, for example, an endless belt running longitudinally from a first point between the rear or upstream end of the support "table" up to a second point downstream from said first point which may be before, at, or even past, the fastening station(s). Where the endless belt extends only up to the at least one fastening station, the conveyancing means may also include drive tires which carry the assembled portion of the door jamb away from the fastening station, and, when the door jamb is completely assembled, transports the finished door jamb downstream for removal.

The conveyancing means is powered by a drive mechanism which may be adapted to move the unassembled door jamb members in a discrete cycle of predetermined distance past the fastening station(s). This allows for the assembly of door jambs of varying lengths. Also, this allows for the continuous assembly of door jambs of like length without the need to set the cycle of the conveyancing means. This cycle length is variable to accommodate the production of side door jambs and top door jambs for a given door opening. This also allows for the production of door jambs for doors of any size, particularly for those which are normally encountered in residential houses. The distance of the cycle of the conveyancing means may be set and controlled by electronic feedback means according to the disclosure herein. Such electronic feedback means control both the cycle of the conveyancing means and the position and number of fasteners placed by each fastening means.

The fastening means of the present invention may include those commonly used in the art. Examples of such fastening means include staple—and nail—driving devices commonly known and available to the art. The fastening means of the present invention are arranged so as to fasten the top member and at least one side member to the jamb member to form the completed door jamb. The fastening means may be placed in any arrangement which is effective to accomplish this task, but preferably the fastening means will be arranged at the same longitudinal location along the supporting table. Depending upon the number of fasteners desired and the speed at which each fastening means can deliver, and also taking into account the speed of the conveyancing means, more than one fastening station may be arranged along the longitudinal path as appropriate. An example of electronic feedback means is provided by an advancer which is slidably mounted along the upstream portion of the longitudinal path. This advancer contains a first optical encoder which cooperates with a second encoder located at the first fastening station to set the desired length of the door jamb to be produced. The advancer also signals the programmable controller to indicate the selected length as the advancer is moved to different positions along the longitudinal path.

The programmable controller activates the conveyancing means to guide the door jamb pieces past the fastening station(s) and controls the number and spacing of nails or staples required to attach the stop member and side member(s) to the jamb member to assemble the finished door jamb.

DETAILED DESCRIPTION OF THE PREFERRED EMBODIMENT

Figure 2:
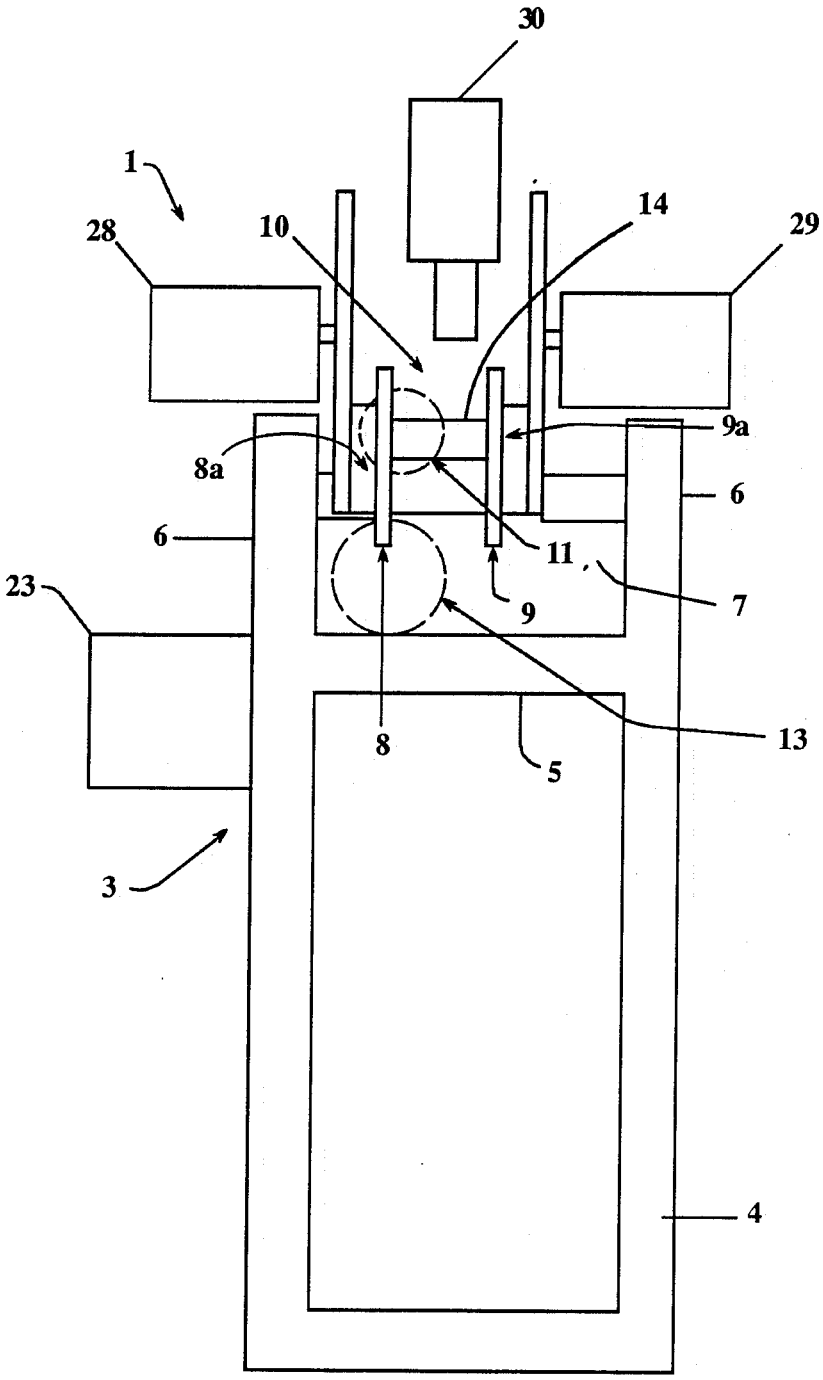
FIG. 2 is a lengthwise view of one embodiment of the present invention taken along line I—I of FIG. 1.

One embodiment of a door jamb assembly machine of the present invention is shown in FIGS. 1 and 2.

FIG. 1 shows a side view of a door jamb machine 1 of the present invention. The machine is comprised by means to support and align a jamb member, a stop member and at least one side member along a longitudinal path 2. The support means in this embodiment include a supporting table 3 which is formed from a structural tube frame weldment having legs 4 and horizontal top 5. The horizontal top 5 has upwardly-extending sides 6 which define an alignment bed 7 for the door jamb pieces.

The alignment bed 7 contains longitudinal plates 8 and 9 which serve to support, align and register the jamb member and the side member(s) in spaces 10, **8*a* and 9*a*, respectively. Plates 8 and 9 are adjustable in the horizontal direction by turning hand wheel 11 to set the width of the side member(s). Plates 8 and 9 are also adjustable in the vertical direction by turning hand wheel 13 which cooperates with ball screws 12** to set the jamb member width. Together, this alignment means provides for sized longitudinal paths for the individual door jamb pieces as they are passed by the fastening station by the conveyancing means.

The conveyancing means of the embodiment of the invention shown in FIG. 1 comprise an endless belt 14 about drive wheels 15 and 16 which advance the jamb member in the downstream direction 17 toward the fastening station 18. The conveyancing means may also include drive tires 24 described below. The conveyancing means also includes a rear stop indexer 19 which serves to index the stop member atop the jamb member so that the stop member can be fastened to the jamb member from above. This is done by a downstream-facing slot in the rear stop indexer into which the rear or upstream end of the stop member fits.

The rear stop indexer serves to move the side member(s) downstream toward the fastening station by use of appendages (not shown) which protrude into spaces **8*a* and 9*a* to push the side member(s) from the rear or upstream end thereof. The rear stop indexer 19 also contains a first optical encoder 20 which cooperates with a second optical encoder 21 to determine the distance of the upstream end of the jamb member to the first fastening station 18. The signal from the optical encoder is then fed to the programmable controller 23 in a manner well known in the art which in turn determines the distance of one cycle of the conveyancing means to bring the door jamb pieces up to the fastening station 18 where attachment of the individual door jamb pieces occurs. The finished portion of the assembled door jamb then encounters drive tires 24 downstream from the fastening station 18. The drive tires 24 are driven by tire motor 25 and act to pull the finished door jamb along the longitudinal path 2 in direction 17 to a conveyor 26 comprised of rollers 27 which carries the finished door jamb assembly away from the fastening station, clearing the longitudinal path for the assembly of another door jamb. The programmable controller allows the rear stop indexer to be set to accommodate door jamb pieces of various lengths and to set the distance of travel of the conveyancing means accordingly. The programmable controller also instructs the rear stop indexer drive means to reverse and return the rear stop indexer to its present upstream point to accept a second set of door jamb pieces of the same length as those preceding them. FIG. 1 shows the rear stop indexer 19 at two positions (A and B) along the longitudinal path 2**.

Located at the fastening station 18 are three stapling tools 28, 29 and 30. Stapling tools 28 and 29 fire staples towards one another in the horizontal direction to attach side members to the jamb member from either or both sides as desired. Stapling tool 30 fires downward from above to attach the stop member to the jamb member. The programmable controller 23 coordinates the movement of the door jamb pieces along the longitudinal path with the firing of the stapling tools to place a desired number of staples at desired distances from one another along the length of the door jamb assembly. A photo sensor 31 feeds back to the programmable controller to indicate whether the door jamb pieces are present or absent to signal the programmable controller when to start or stop the firing of the stapling tools. Stapling tool 28 is fed by staple magazine 32 and stapling tool 29 is fed by an accordingly situated staple magazine (not shown). Stapling tool 30 is fed by staple magazine 33.

The programmable controller can also be set to determine whether stapling tools 28 and 29 will or will not be fired during a given cycle of the conveyancing means to allow the assembly of door jambs with side members on one or both sides as desired. Another function of the programmable controller is to hold in memory the position of the rear stop indexer 19 so that a number of like-sized door jamb assemblies can be made. The length of a given door jamb assembly can be varied in the machine shown in FIG. 1 from a length of from about one foot six inches (1'6") to about seven feet (7'0"). This allows the operator to construct door jamb assemblies of various lengths for use as side door jambs or headers for door openings of various dimensions.

The housing 34 is also vertically adjustable so as to provide for jamb member thickness adjustment. The housing also contains structural means to align the front or downstream end of the stop member as it enters the fastening station. This is preferably two angle pieces which form a v-shaped path through which the stop member must pass en route to the fastening station.

Various modifications including (1) the use of additional fastening stations, (2) a variation in the number and arrangement of fastening means (i.e. stapling tools or nailing tools), and (3) a variation in the dimensions of the alignment bed to accommodate door jamb pieces as desired, may be made to the invention without departing from its spirit.

What is claimed is:

1. An apparatus for constructing a door jamb assembly consisting of a jamb member, a pair of side members, and a stop member, comprising:

means for supporting the jamb member;

means for positioning the side members in the proper position relative to the jamb member;

means for aligning the stop member in the proper position relative to the jamb member;

fastening means containing a plurality of fasteners;

means for conveying the jamb member, side members, and stop members past said fastening means; and means for actuating said fastening means to permanently fasten the jamb member, side members, and stop member into a door jamb assembly.

2. The apparatus of claim 1, wherein said fastening means is periodically actuated to insert fasteners at predetermined locations along said door jamb assembly.

3. The apparatus of claim 1, wherein said supporting means is adjustable to accommodate jamb members of varying width and thickness.

4. The apparatus of claim 1, further comprising means for monitoring the length of said door jamb assembly.

5. The apparatus of claim 4, wherein said actuating means operates said fastening means in response to said monitoring means.

6. The apparatus of claim 4, wherein said monitoring means consists of a pair of optical encoders.

7. The apparatus of claim 1, wherein said aligning means is shiftable toward said conveying means to transport the door jamb assembly members to said conveying means.

8. The apparatus of claim 1, wherein said conveying means consists of an endless belt.

9. A machine for constructing a door jamb assembly consisting of a jamb member, a pair of side members, and a stop member, comprising:

a frame;

a support for holding a jamb member in position upon said frame;

a pair of vertical plates, with one located on each side of said jamb support, for positioning a side member on each side of said jamb member;

a fastening station, supported upon said frame, containing a plurality of fastening tools;

an indexing stop, supported on and shiftable along said frame, for positioning a stop member on the jamb member;

a conveyor, supported on said frame between said fastening station and said indexing stop, for transporting the jamb member, side members, and stop member in a preferred relationship to said fastening station;

and a controller for activating said tools at said fastening station, whereby said stop and said conveyor act to transport the positioned jamb member, side members, and stop member to said fastening station where the members are fastened together to form a door jamb assembly.

10. The machine of claim 9, wherein said controller is programmable to activate said fastening tools at predetermined times.

11. The machine of claim 9, further comprising a photo sensor located at said fastening station to indicate the presence of a member at said station.

12. The machine of claim 9, further comprising a first detector located at said fastening station, and a second detector located on said indexing stop.

13. The machine of claim 12, wherein said first and second detectors monitor the length of each door jamb assembly.

14. The machine of claim 9, wherein said pair of vertical plates are adjustable relative to each other to accommodate jamb members of different sizes.

15. The machine of claim 9, wherein said indexing stop moves along behind the members and returns to its prior starting position after each machine cycle.

16. The machine of claim 9, wherein said controller counts the number of cycles performed by said machine.

17. The machine of claim 9, further comprising means for transporting a finished door jamb assembly away from said fastening station.

* * * * *